US009997121B2

(12) United States Patent
Wang et al.

(10) Patent No.: US 9,997,121 B2
(45) Date of Patent: Jun. 12, 2018

(54) DISPLAY WITH PHYSICALLY MODELED CHARGE ACCUMULATION TRACKING

(71) Applicant: Apple Inc., Cupertino, CA (US)

(72) Inventors: Chaohao Wang, Cupertino, CA (US); Hao Nan, Stanford, CA (US); Paolo Sacchetto, Cupertino, CA (US); Zhibing Ge, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 128 days.

(21) Appl. No.: 14/718,515

(22) Filed: May 21, 2015

(65) Prior Publication Data

US 2016/0343318 A1 Nov. 24, 2016

(51) Int. Cl.
*G09G 3/36* (2006.01)

(52) U.S. Cl.
CPC ..... *G09G 3/3614* (2013.01); *G09G 3/3648* (2013.01); *G09G 2320/0204* (2013.01); *G09G 2320/0247* (2013.01); *G09G 2320/0257* (2013.01); *G09G 2320/041* (2013.01); *G09G 2340/0435* (2013.01); *G09G 2340/16* (2013.01); *G09G 2360/18* (2013.01)

(58) Field of Classification Search
CPC ..... G09G 1/005; G09G 2310/0245; G09G 2310/063; G09G 2330/00; G09G 2330/02; G09G 2330/021; G09G 2330/022; G09G 2330/023; G09G 2330/024; G09G 2330/025; G09G 2330/026; G09G 2330/027; G09G 2330/028; G09G 3/3614; G09G 3/3648; G09G 2340/16; G09G 2340/0435; G09G 2320/041; G09G 2320/0204; G09G 2320/0257; G09G 2360/18; G09G 2320/0247
See application file for complete search history.

(56) References Cited

U.S. PATENT DOCUMENTS 5,926,162 A * 7/1999 Wood ..... G09G 3/3648 345/101
6,014,035 A * 1/2000 Taniguchi ..... G09G 3/006 324/73.1
7,633,474 B2 * 12/2009 Lee ..... G09G 3/3648 345/100
8,134,151 B2 3/2012 Imai
8,175,447 B2 5/2012 Yakaiwa
8,405,690 B2 3/2013 Goetz et al.
(Continued)

*Primary Examiner* — Grant Sitta
(74) *Attorney, Agent, or Firm* — Treyz Law Group, P.C.; G. Victor Treyz; Joseph F. Guihan

(57) ABSTRACT

An electronic device may generate content that is to be displayed on a display. The display may have an array of liquid crystal display pixels for displaying image frames of the content. A charge accumulation tracker may analyze the image frames to determine when there is a risk of excess charge accumulation. The charge accumulation tracker may implement a physically derived circuit model of the pixels. A charge accumulation input response matrix and a charge accumulation state response matrix for the model may be stored in look-up table circuitry and used in computing a current charge accumulation state based on current pixel voltage information and previous state information. The impact of temperature, backlight illumination level, frame duration, and other factors may be taken into account in evaluating the current charge accumulation state.

9 Claims, 11 Drawing Sheets

(56) References Cited

U.S. PATENT DOCUMENTS 8,816,999 B2 * 8/2014 Dallas ..... G02F 1/133553 345/205
8,908,071 B2 12/2014 Panicacci
8,928,787 B2 1/2015 Takane
2003/0107546 A1 * 6/2003 Ham ..... G09G 3/3648 345/101
2003/0156092 A1 * 8/2003 Suzuki ..... G09G 3/3685 345/98
2003/0179175 A1 * 9/2003 Shigeta ..... G09G 3/3648 345/101
2004/0189837 A1 * 9/2004 Kido ..... H04N 5/243 348/241
2004/0201564 A1 * 10/2004 Sugino ..... G09G 3/3611 345/101
2004/0263450 A1 * 12/2004 Lee ..... G09G 3/006 345/87
2006/0050038 A1 * 3/2006 Cheon ..... G09G 3/3648 345/89
2006/0145978 A1 * 7/2006 Takatori ..... G09G 3/2014 345/87
2009/0321163 A1 * 12/2009 Suzui ..... B60K 6/365 180/65.265
2010/0013953 A1 * 1/2010 Niikura ..... H04N 5/2357 348/226.1
2010/0090092 A1 * 4/2010 Yamashita ..... H04N 5/3765 250/208.1
2011/0221723 A1 * 9/2011 Kurokawa ..... G06F 3/042 345/207
2013/0222754 A1 * 8/2013 Kohtoku ..... G02F 1/133603 349/161
2014/0176614 A1 * 6/2014 Rosenberg ..... G09G 3/344 345/690
2015/0243234 A1 * 8/2015 Bloks ..... G09G 3/3614 345/96
2015/0312459 A1 * 10/2015 Nakagawara ..... H04N 5/2357 348/228.1

* cited by examiner $$\overbrace{[CS]} = \overbrace{[IR]\,V_{inlk}} + \overbrace{[SR] \bullet [PS]}$$

$$\begin{bmatrix} V_{1lk} \\ V_{2lk} \\ V_{3lk} \end{bmatrix} = \begin{bmatrix} IR_1 \\ IR_2 \\ IR_3 \end{bmatrix} V_{inlk} + \begin{bmatrix} SR_{i,1} & SR_{1,1} & SR_{2,1} & SR_{3,1} \\ SR_{i,2} & SR_{1,2} & SR_{2,2} & SR_{3,2} \\ SR_{i,3} & SR_{1,3} & SR_{2,3} & SR_{3,3} \end{bmatrix} \begin{bmatrix} V_{inlk-1} \\ V_{1lk-1} \\ V_{2lk-1} \\ V_{3lk-1} \end{bmatrix}$$

*FIG. 10*

DISPLAY WITH PHYSICALLY MODELED CHARGE ACCUMULATION TRACKING

BACKGROUND

This relates generally to electronic devices, and more particularly, to electronic devices with displays.

Electronic devices often include displays. For example, cellular telephones and portable computers often include displays for presenting information to a user.

Liquid crystal displays contain a layer of liquid crystal material. Pixels in a liquid crystal display contain thin-film transistors and pixel electrodes for applying electric fields to the liquid crystal material. The strength of the electric field in a pixel controls the polarization state of the liquid crystal material and thereby adjusts the brightness of the pixel.

There is a potential for ions in a liquid crystal display to move in response to applied electric fields. This can lead to charge accumulation on the pixels. Another cause of charge accumulation is dielectric polarization. Charge accumulation effects can produce visible artifacts on a display such as undesired flickering.

To minimize charge accumulation in a liquid crystal display, the polarity of the electric field applied to the pixels may be periodically reversed. For example, alternating positive polarity and negative polarity frames of image data may be displayed on the pixels of a liquid crystal display to prevent excess positive or negative charge accumulation. Although periodic polarity reversal can help reduce charge accumulation, charge accumulation issues may still arise in liquid crystal displays. Charge accumulation may arise, for example, in situations in which a software application or other content generator creates negative and positive frames of image data with unbalanced gray levels. The risk of undesired charge accumulation may be exacerbated in displays with a variable refresh rate.

It would therefore be desirable to be able to provide displays with enhanced charge accumulation mitigation capabilities.

SUMMARY

An electronic device may generate content that is to be displayed on a display. The display may be a liquid crystal display have an array of liquid crystal display pixels. Display driver circuitry in the display may display image frames on the array of pixels.

A charge accumulation tracker may analyze the image frames to determine when there is a risk of excess charge accumulation in the pixels of the array. The charge accumulation tracker may implement a physically derived circuit model of the pixels. Parameters for the model such as a charge accumulation input response matrix and charge accumulation state response matrix may be stored in look-up table circuitry and used in updating a current charge accumulation state based on current pixel voltage information and previous state information. The impact of temperature, backlight illumination level, frame duration, and other factors may be taken into account in evaluating the current charge accumulation state. The current charge accumulation state may be compared to a threshold to determine when remedial action should be taken due to excess charge accumulation.

BRIEF DESCRIPTION OF THE DRAWINGS

FIG. 10 shows parameters associated with modeling the charge accumulation behavior of the pixels of FIGS. 8 and 9 using a physically derived circuit model of the type shown in FIG. 9 in accordance with an embodiment.

DETAILED DESCRIPTION

Electronic devices may include displays. The displays may be used to display images to a user. Illustrative electronic devices that may be provided with displays are shown in FIGS. 1, 2, 3, and 4.

Figure 1:
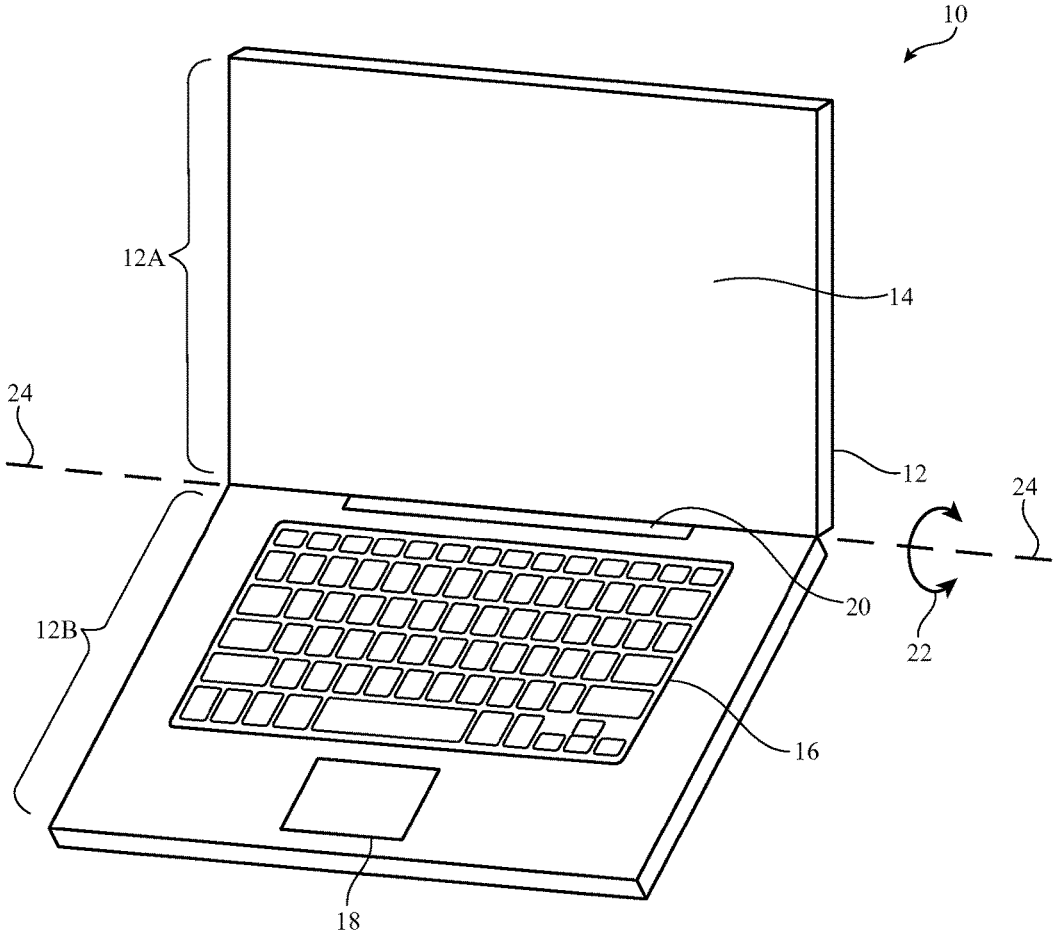
FIG. 1 is a perspective view of an illustrative electronic device such as a laptop computer with a display in accordance with an embodiment.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24.

Figure 2:
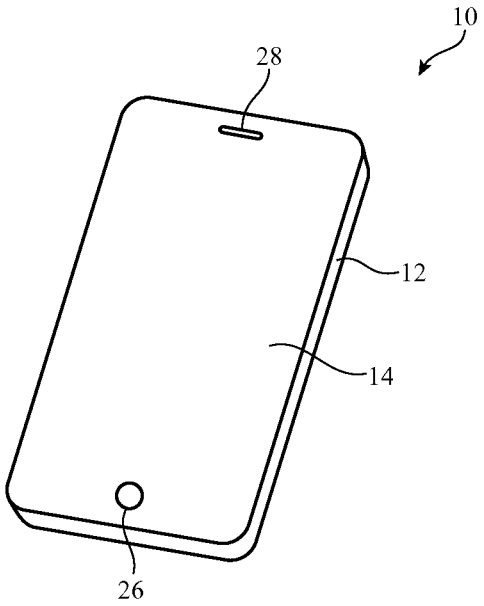
FIG. 2 is a perspective view of an illustrative electronic device such as a handheld electronic device with a display in accordance with an embodiment.

FIG. 2 shows how electronic device 10 may be a handheld device such as a cellular telephone, music player, gaming device, navigation unit, watch, or other compact device. In this type of configuration for device 10, housing 12 may have opposing front and rear surfaces. Display 14 may be mounted on a front face of housing 12. Display 14 may, if desired, have openings for components such as button 26. Openings may also be formed in display 14 to accommodate a speaker port (see, e.g., speaker port 28 of FIG. 2). In compact devices such as wrist-watch devices, port 28 and/or button 26 may be omitted and device 10 may be provided with a strap or lanyard.

Figure 3:
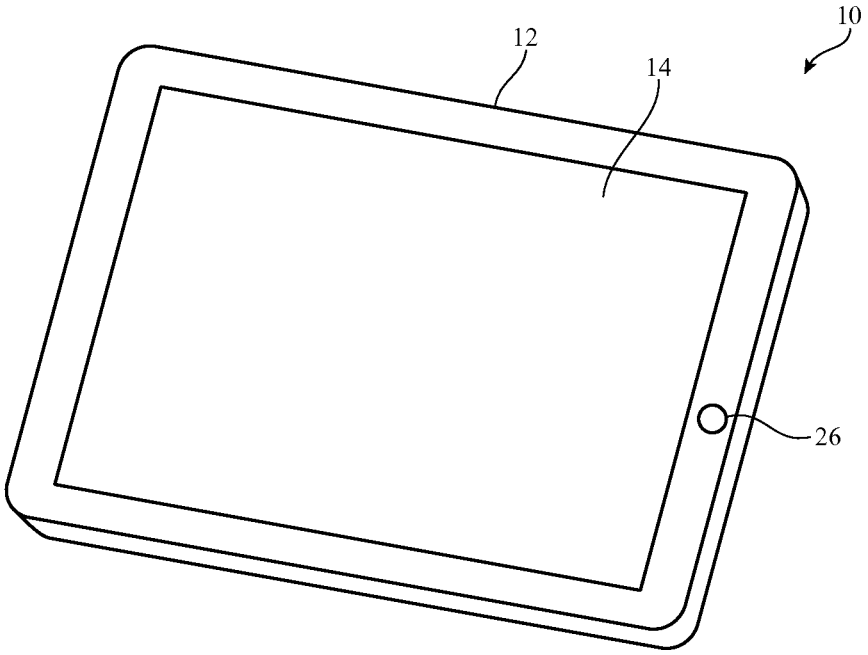
FIG. 3 is a perspective view of an illustrative electronic device such as a tablet computer with a display in accordance with an embodiment.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have an opening to accommodate button 26 (as an example).

Figure 4:
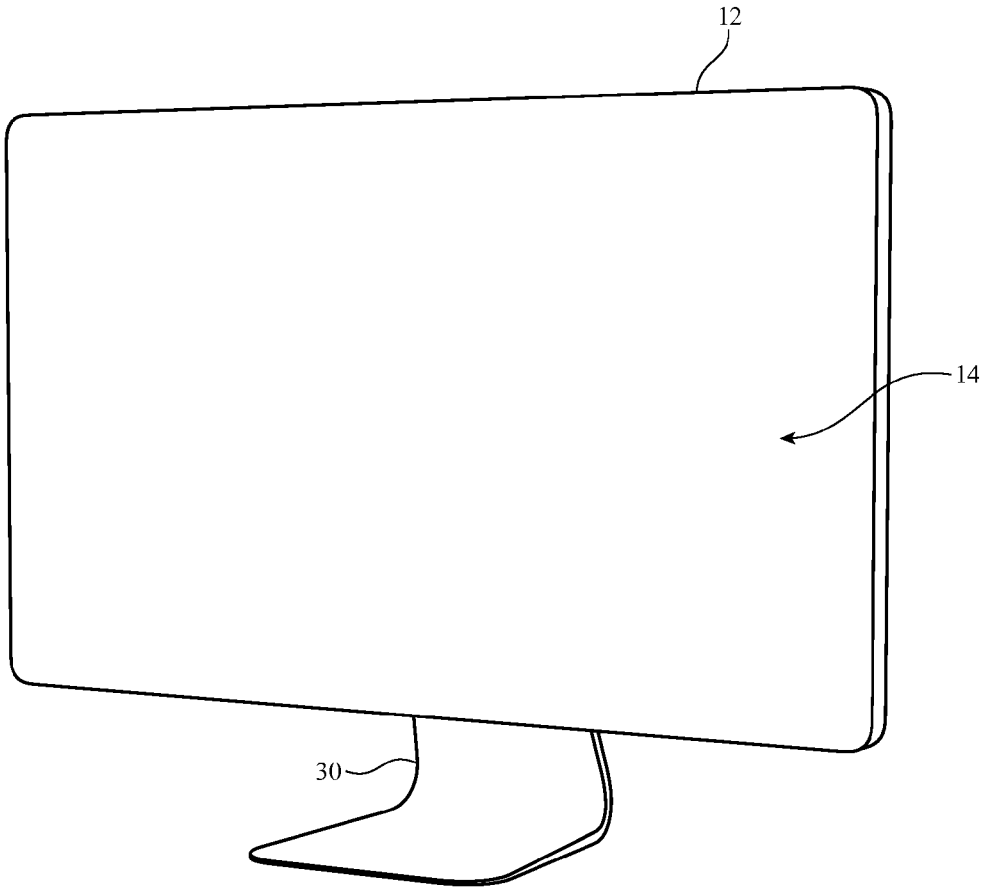
FIG. 4 is a perspective view of an illustrative electronic device such as a computer or other device with display structures in accordance with an embodiment.

FIG. 4 shows how electronic device 10 may be a display such as a computer monitor, a computer that has been integrated into a computer display, or other device with a built-in display. With this type of arrangement, housing 12 for device 10 may be mounted on a support structure such as stand 30 or stand 30 may be omitted (e.g., to mount device 10 on a wall). Display 14 may be mounted on a front face of housing 12.

The illustrative configurations for device 10 that are shown in FIGS. 1, 2, 3, and 4 are merely illustrative. In general, electronic device 10 may be a laptop computer, a tablet computer, a cellular telephone, a media player, or other handheld or portable electronic device, a smaller device such as a wrist-watch device, a pendant device, a headphone or earpiece device, or other wearable or miniature device, a computer monitor or other display containing an embedded computer, a computer monitor or other display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Display 14 for device 10 may include pixels formed from liquid crystal display (LCD) components. A display cover layer may cover the surface of display 14 or a display layer such as a color filter layer or other portion of a display may be used as the outermost (or nearly outermost) layer in display 14. The outermost display layer may be formed from a transparent glass sheet, a clear plastic layer, or other transparent member.

Figure 5:
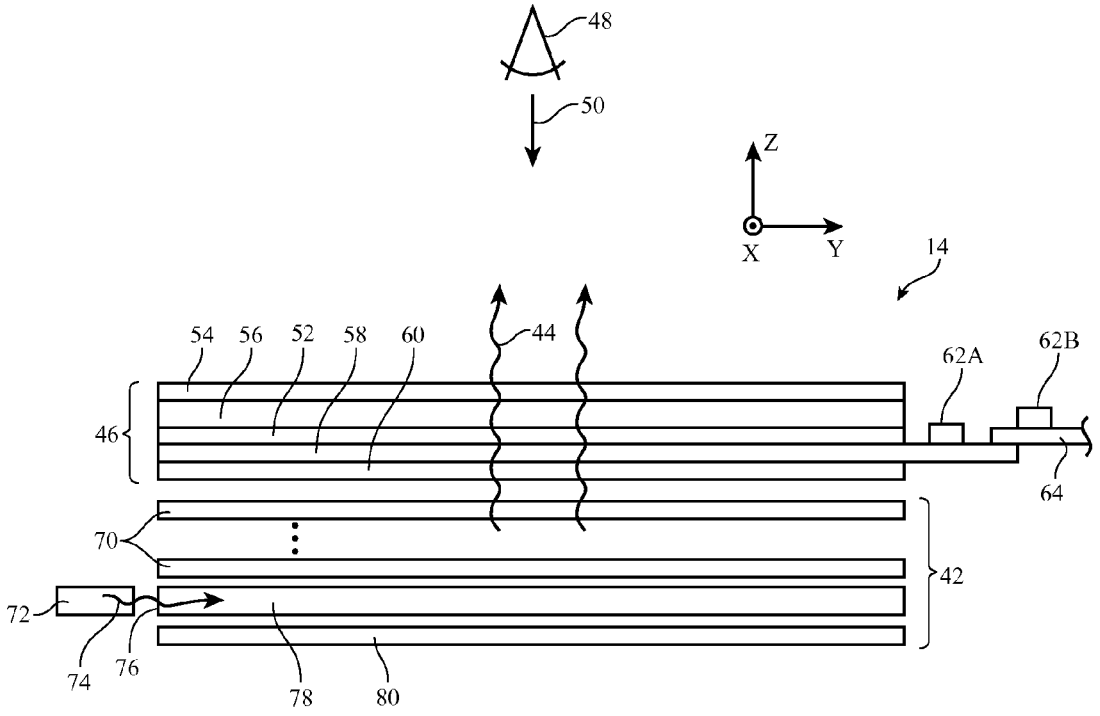
FIG. 5 is a cross-sectional side view of an illustrative display in accordance with an embodiment.

A cross-sectional side view of an illustrative configuration for display 14 of device 10 (e.g., for display 14 of the devices of FIG. 1, FIG. 2, FIG. 3, FIG. 4 or other suitable electronic devices) is shown in FIG. 5. As shown in FIG. 5, display 14 may include backlight structures such as backlight unit 42 for producing backlight 44. During operation, backlight illumination 44 travels outwards (vertically upwards in dimension Z in the orientation of FIG. 5) and passes through display pixel structures in display layers 46. This illuminates any images that are being produced by the display pixels for viewing by a user. For example, backlight 44 may illuminate images on display layers 46 that are being viewed by viewer 48 in direction 50.

Display layers 46 may be mounted in chassis structures such as a plastic chassis structure and/or a metal chassis structure to form a display module for mounting in housing 12 or display layers 46 may be mounted directly in housing 12 (e.g., by stacking display layers 46 into a recessed portion in housing 12). Display layers 46 may form a liquid crystal display or may be used in forming displays of other types.

Display layers 46 may include a liquid crystal layer such a liquid crystal layer 52. Liquid crystal layer 52 may be sandwiched between display layers such as display layers 58 and 56. Layers 56 and 58 may be interposed between lower polarizer layer 60 and upper polarizer layer 54.

Layers 58 and 56 may be formed from transparent substrate layers such as clear layers of glass or plastic. Layers 58 and 56 may be layers such as a thin-film transistor layer and/or a color filter layer. Conductive traces, color filter elements, transistors, and other circuits and structures may be formed on the substrates of layers 58 and 56 (e.g., to form a thin-film transistor layer and/or a color filter layer). Touch sensor electrodes may also be incorporated into layers such as layers 58 and 56 and/or touch sensor electrodes may be formed on other substrates.

With one illustrative configuration, layer 58 may be a thin-film transistor layer that includes an array of pixel circuits based on thin-film transistors and associated electrodes (pixel electrodes) for applying electric fields to liquid crystal layer 52 and thereby displaying images on display 14. Layer 56 may be a color filter layer that includes an array of color filter elements for providing display 14 with the ability to display color images. If desired, layer 58 may be a color filter layer and layer 56 may be a thin-film transistor layer. Configurations in which color filter elements are combined with thin-film transistor structures on a common substrate layer in the upper or lower portion of display 14 may also be used.

During operation of display 14 in device 10, control circuitry (e.g., one or more integrated circuits on a printed circuit) may be used to generate information to be displayed on display 14 (e.g., display data). The information to be displayed may be conveyed to display driver circuitry (e.g., a display driver integrated circuit such as circuit 62A or 62B) using a signal path such as a signal path formed from conductive metal traces in a rigid or flexible printed circuit such as printed circuit 64 (as an example).

Backlight structures 42 may include a light guide layer such as light guide layer 78. Light guide layer 78 may be formed from a transparent material such as clear glass or plastic. For example, light guide layer 78 may be a molded plastic light guide plate or a thin flexible plastic light guide film. During operation of backlight structures 42, a light source such as light source 72 may generate light 74. Light source 72 may be, for example, an array of light-emitting diodes.

Light 74 from light source 72 may be coupled into edge surface 76 of light guide layer 78 and may be distributed in dimensions X and Y throughout light guide layer 78 due to the principal of total internal reflection. Light guide layer 78 may include light-scattering features such as pits or bumps. The light-scattering features may be located on an upper surface and/or on an opposing lower surface of light guide layer 78. Light source 72 may be located at the left of light guide layer 78 as shown in FIG. 5 or may be located along the right edge of layer 78 and/or other edges of layer 78.

Light 74 that scatters upwards in direction Z from light guide layer 78 may serve as backlight 44 for display 14. Light 74 that scatters downwards may be reflected back in the upwards direction by reflector 80. Reflector 80 may be formed from a reflective material such as a layer of plastic covered with a dielectric mirror thin-film coating.

To enhance backlight performance for backlight structures 42, backlight structures 42 may include optical films 70. Optical films 70 may include diffuser layers for helping to homogenize backlight 44 and thereby reduce hotspots, compensation films for enhancing off-axis viewing, and brightness enhancement films (also sometimes referred to as turning films) for collimating backlight 44. Optical films 70 may overlap the other structures in backlight unit 42 such as light guide layer 78 and reflector 80. For example, if light guide layer 78 has a rectangular footprint in the X-Y plane of FIG. 5, optical films 70 and reflector 80 may have a matching rectangular footprint. If desired, films such as compensation films may be incorporated into other layers of display 14 (e.g., polarizer layers).

Figure 6:
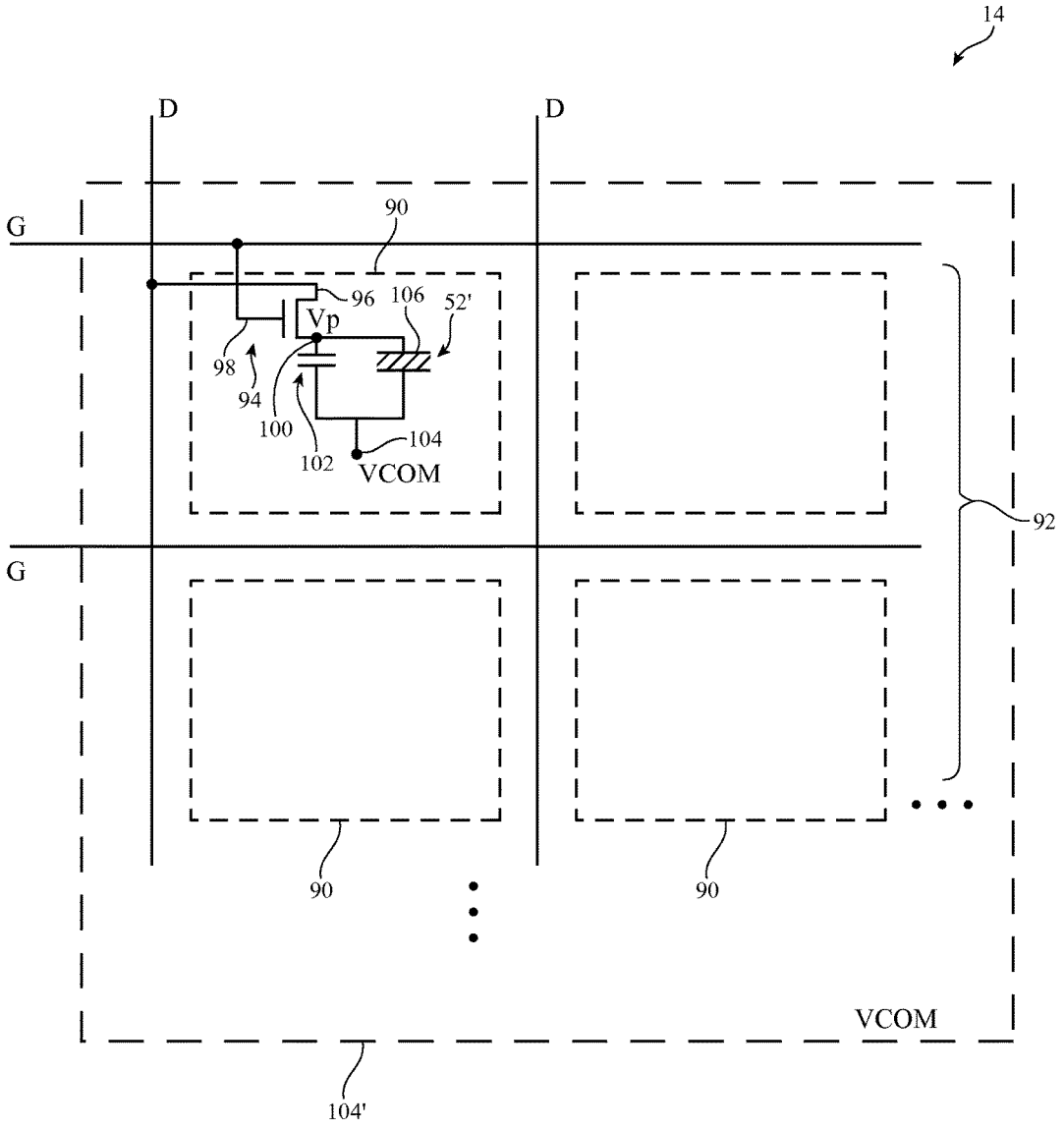
FIG. 6 is a top view of a portion of an array of pixels in a display in accordance with an embodiment.

As shown in FIG. 6, display 14 may include an array of pixels 90 such as pixel array 92. Pixel array 92 may be controlled using control signals produced by display driver circuitry. Display driver circuitry may be implemented using one or more integrated circuits (ICs) and/or thin-film transistors or other circuitry.

During operation of device 10, control circuitry in device 10 such as memory circuits, microprocessors, and other storage and processing circuitry may provide data to the display driver circuitry. The display driver circuitry may convert the data into signals for controlling pixels 90 of pixel array 92.

Pixel array 92 may contain rows and columns of pixels 90. The circuitry of pixel array 92 (i.e., the rows and columns of pixel circuits for pixels 90) may be controlled using signals such as data line signals on data lines D and gate line signals on gate lines G. Data lines D and gate lines G are orthogonal. For example, data lines D may extend vertically and gate lines G may extend horizontally (i.e., perpendicular to data lines D).

Pixels 90 in pixel array 92 may contain thin-film transistor circuitry (e.g., polysilicon transistor circuitry, amorphous silicon transistor circuitry, semiconducting-oxide transistor circuitry such as indium gallium zinc oxide transistor circuitry, other silicon or semiconducting-oxide transistor circuitry, etc.) and associated structures for producing electric fields across liquid crystal layer 52 in display 14. Each liquid crystal display pixel may have one or more thin-film transistors. For example, each pixel may have a respective thin-film transistor such as thin-film transistor 94 to control the application of electric fields to a respective pixel-sized portion 52' of liquid crystal layer 52.

The thin-film transistor structures that are used in forming pixels 90 may be located on a thin-film transistor substrate such as a layer of glass. The thin-film transistor substrate and the structures of display pixels 90 that are formed on the surface of the thin-film transistor substrate collectively form thin-film transistor layer 58 (FIG. 5).

Gate driver circuitry may be used to generate gate signals on gate lines G. The gate driver circuitry may be formed from thin-film transistors on the thin-film transistor layer or may be implemented in separate integrated circuits. The data line signals on data lines D in pixel array 92 carry analog image data (e.g., voltages with magnitudes representing pixel brightness levels). During the process of displaying images on display 14, a display driver integrated circuit or other circuitry may receive digital data from control circuitry and may produce corresponding analog data signals. The analog data signals may be demultiplexed and provided to data lines D.

The data line signals on data lines D are distributed to the columns of display pixels 90 in pixel array 92. Gate line signals on gate lines G are provided to the rows of pixels 90 in pixel array 92 by associated gate driver circuitry.

The circuitry of display 14 may be formed from conductive structures (e.g., metal lines and/or structures formed from transparent conductive materials such as indium tin oxide) and may include transistors such as transistor 94 of FIG. 6 that are fabricated on the thin-film transistor substrate layer of display 14. The thin-film transistors may be, for example, silicon thin-film transistors or semiconducting-oxide thin-film transistors.

As shown in FIG. 6, pixels such as pixel 90 may be located at the intersection of each gate line G and data line D in array 92. A data signal on each data line D may be supplied to terminal 96 from one of data lines D. Thin-film transistor 94 (e.g., a thin-film polysilicon transistor, an organic thin-film transistor, or a thin-film transistor formed from a semiconducting oxide such as indium gallium zinc oxide) may have a gate terminal such as gate 98 that receives gate line control signals on gate line G. When a gate line control signal is asserted, transistor 94 will be turned on and the data signal at terminal 96 will be passed to node 100 as pixel voltage Vp. Data for display 14 may be displayed in frames. Following assertion of the gate line signal in each row to pass data signals to the pixels of that row, the gate line signal may be deasserted. In a subsequent display frame, the gate line signal for each row may again be asserted to turn on transistor 94 and capture new values of Vp.

Pixel 90 may have a signal storage element such as capacitor 102 or other charge storage elements. Storage capacitor 102 may be used to help store signal Vp in pixel 90 between frames (i.e., in the period of time between the assertion of successive gate signals). Pixel voltage Vp may sometimes be referred to as the input voltage or data voltage for pixel 90.

Display 14 may have a common electrode coupled to node 104. The common electrode (which is sometimes referred to as the common voltage electrode, Vcom electrode, or Vcom terminal) may be used to distribute a common electrode voltage such as common electrode voltage Vcom to nodes such as node 104 in each pixel 90 of array 92. As shown by illustrative electrode pattern 104' of FIG. 6, Vcom electrode 104 may be implemented using a blanket film of a transparent conductive material such as indium tin oxide, indium zinc oxide, other transparent conductive oxide material, and/or a layer of metal that is sufficiently thin to be transparent (e.g., electrode 104 may be formed from a layer of indium tin oxide or other transparent conductive layer that covers all of pixels 90 in array 92).

In each pixel 90, capacitor 102 may be coupled between nodes 100 and 104. A parallel capacitance arises across nodes 100 and 104 due to electrode structures in pixel 90 that are used in controlling the electric field through the liquid crystal material of the pixel (liquid crystal material 52'). As shown in FIG. 6, electrode structures 106 (e.g., a display pixel electrode with multiple fingers or other display pixel electrode for applying electric fields to liquid crystal material 52') may be coupled to node 100 (or a multi-finger display pixel electrode may be formed at node 104). During operation, electrode structures 106 may be used to apply a controlled electric field (i.e., a field having a magnitude proportional to Vp-Vcom) across pixel-sized liquid crystal material 52' in pixel 90. Due to the presence of storage capacitor 102 and the parallel capacitances formed by the pixel structures of pixel 90, the value of Vp (and therefore the associated electric field across liquid crystal material 52') may be maintained across nodes 106 and 104 for the duration of the frame.

The electric field that is produced across liquid crystal material 52' causes a change in the orientations of the liquid crystals in liquid crystal material 52'. This changes the polarization of light passing through liquid crystal material 52'. The change in polarization may, in conjunction with polarizers 60 and 54 of FIG. 5, be used in controlling the amount of light 44 that is transmitted through each pixel 90 in array 92 of display 14 so that image frames may be displayed on display 14.

Charge accumulation issues may arise from repeated application of electric fields across liquid crystal material 52' using applied voltages Vp-Vcom of a single polarity. Accordingly, the polarity of the electric field may be periodically alternated. As an example, in odd frames a positive voltage Vp-Vcom may be applied across material 52', whereas in even frames a negative voltage Vp-Vcom may be applied across material 52'. To ensure that charge accumulation effects are not present (even when periodically reversing the polarity of the image frames), device 10 can incorporate charge accumulation monitoring functionality. For example, a charge accumulation tracker can be implemented in device 10 that monitors display 14 for excessive charge accumulation conditions. If suitable criteria are satisfied (i.e., if a calculated charge accumulation level exceeds a predetermined charge accumulation threshold for all or part of display 14), appropriate remedial actions may be taken.

Charge accumulation effects arise when non-black content is displayed. Black content and other content with low gray levels does not involve application of large electric fields to display 14 and therefore does not give rise to significant charge accumulation. Content with large gray levels (e.g., white content), however, is associated with large electric fields across layer 52 and therefore has the potential to lead to charge accumulation. In addition to being dependent on the gray level of displayed image frames, charge accumulation effects are also dependent on the amount of time that white content (high gray level content) is displayed for each polarity. Other factors that can affect charge accumulation include the operating temperature of display 14 and the amount of light 44 being produced by backlight unit 42 (which can affect the resistance of insulating structures in pixels 90).

Charge accumulation can become excessive when the images that are displayed on display 14 do not contain content that is evenly divided between positive and negative frames. For example, excessive charge accumulation conditions may arise when more white content is displayed during positive frames than during negative frames. The likelihood that excessive charge accumulation conditions will arise may be exacerbated in displays that implement variable refresh rate schemes. With a variable refresh rate scheme, display 14 is sometimes operated with a relatively high frame rate and is sometimes operated with a relatively low frame rate. The high frame rate may be used to display rapidly moving content. The low frame rate may be used to conserve power when content is changing less rapidly.

Figure 7:
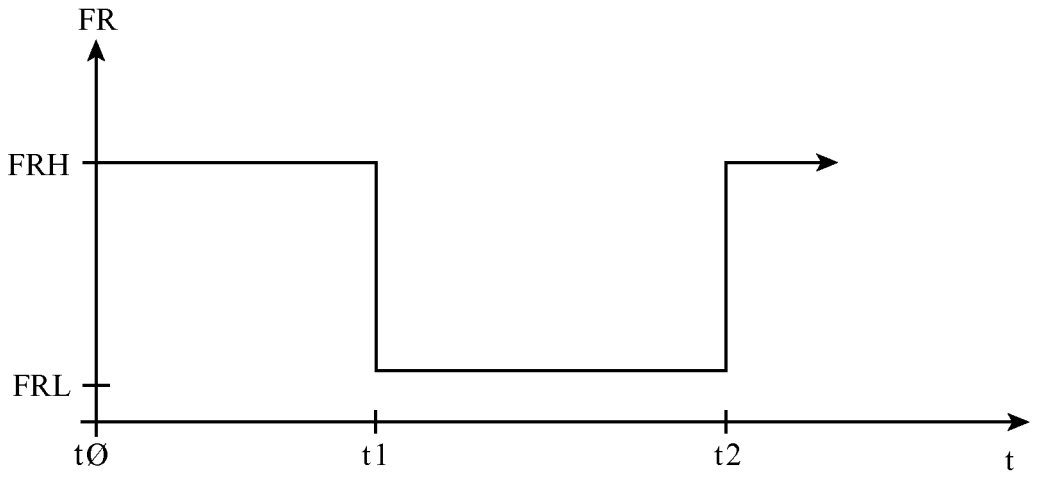
FIG. 7 is a graph showing how the refresh rate of a display may be varied as a function of time in accordance with an embodiment.

A graph in which frame rate FR has been plotted as a function of time in an illustrative configuration in which display 14 has variable refresh rate capabilities is shown in FIG. 7. As shown in FIG. 7, display 14 may be operated at an elevated frame rate FRH when it is desired to display rapidly moving content on display 14 (e.g., video). Frame rate FRH may be, for example, 60 Hz, 30 Hz, or other relatively high frame rate. In the example of FIG. 7, display 14 uses frame rate FRH at times between t0 and t1. At time t1, elevated frame rate FRH is no longer needed, so device 10 lowers frame rate FR for display 14 to lowered frame rate FRL (e.g., for times between t1 and t2, before frame rate FR is returned to high frame rate FRH). Frame rate FRL may be, for example, a rate between 1 Hz and 10 Hz, less than 10 Hz, or other frame rate lower than frame rate FRH. Because the frame rate has been reduced, power consumption at times between times t1 and t2 may be reduced within display 14.

The reduced frame rates that are involved in operating a display with variable refresh rate capabilities are associated with frames of potentially long duration (e.g., 1 s, etc.). Particularly in scenarios in which display 14 is operating with long frames, there is a potential for an undesirable interplay between the pattern of content being displayed on display 14 and the polarities of the frames that can lead to excessive charge accumulation.

To ensure that device 10 and display 14 operate satisfactorily, a charge accumulation tracker may be implemented that monitors for the occurrence of conditions that are likely associated with excess charge accumulation. When charge accumulation is detected, remedial actions may be taken. For example, in a display with variable refresh rate capabilities, variable refresh operations can be suspended (e.g., by returning device 10 to high refresh rate FRH for a given period of time or by at least elevating the frame rate for display 14 above desired low rate FRL for a given period of time). As another example, the polarity of the frames of image data being displayed on display 14 can be flipped (e.g., by inserting an extra positive frame between a positive frame and a negative frame).

The charge accumulation tracker can be spatially sensitive. For example, display 14 may be divided into multiple subregions (e.g., rectangular blocks), each of which may be monitored separately to determine whether excessive charge accumulation is present. The charge accumulation tracker may also take into account the gray level of displayed content, weighting higher gray levels (whiter content) more heavily than lower gray levels (darker content). The duration of positive and negative frames (which affects how long the content is displayed with each polarity) can also be taken into account as can the current temperature and setting of backlight unit 42. This information can be processed using look-up tables or other data structures implemented in device 10. A charge accumulation model such as a physically derived circuit model of pixels 90 may be used to determine appropriate entries for the look-up tables and appropriate equations to use in calculating charge accumulation states. The charge accumulation model may be implemented by the charge accumulation tracker using matrices having values stored in the look-up tables.

Figure 8:
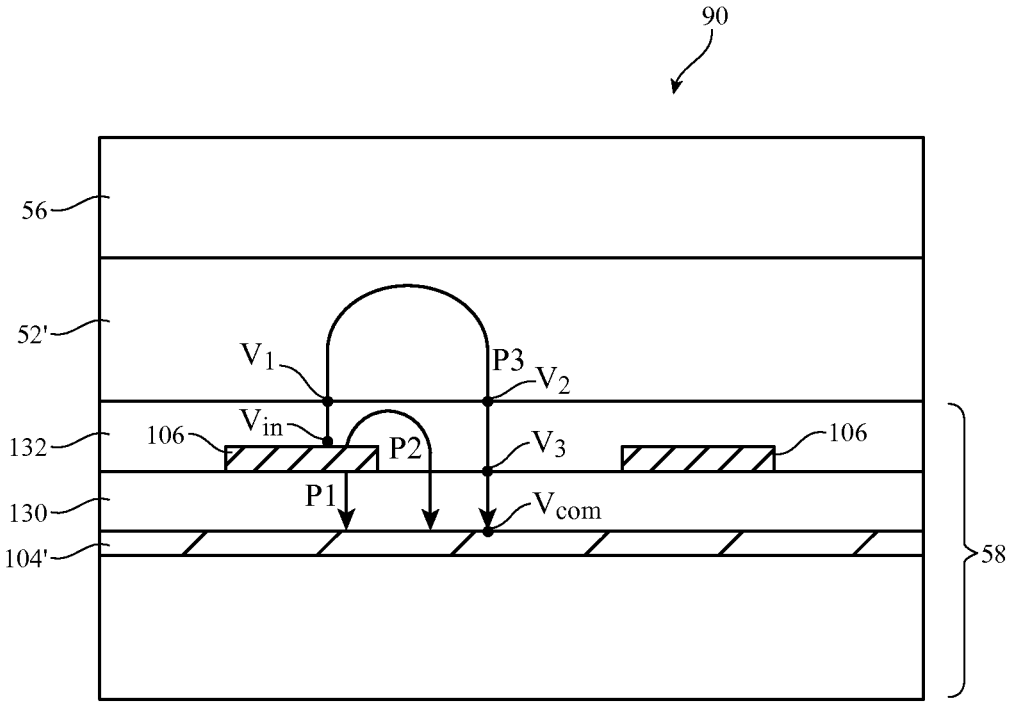
FIG. 8 is a cross-sectional side view of a portion of an illustrative thin-film transistor layer in a display showing various contributions to the electrical behavior of a pixel in accordance with an embodiment.

The charge accumulation model may represent the circuit behavior of pixels 90 as a function of time under various changing conditions (gray levels, temperatures, frame durations, backlight levels, previous pixel voltage states, etc.). A cross-sectional side view of an illustrative pixel 90 that may be electrically modeled using a physically derived charge accumulation circuit model is shown in FIG. 8. As shown in FIG. 8, pixel 90 may include a portion of liquid crystal material 52' sandwiched between color filter layer 56 and thin-film transistor layer 58. During operation of pixel 90, the display driver circuitry of display 14 loads a data signal Vin (see, e.g., Vp of FIG. 6) onto electrodes 106. Electrodes 106 may be formed from a conductive material patterned onto the surface of dielectric layer 130 (e.g., a layer of silicon nitride or other dielectric). Dielectric 132 (e.g., a layer of polyimide or other polymer) may cover electrodes 106 and may separate electrodes 106 from liquid crystal layer 52'. The resistance of layer 132 may change as a function of exposure to light, so the current level of backlight illumination 44 that is being emitted by backlight unit 42 may impact the resistance of layer 132.

Figure 9:
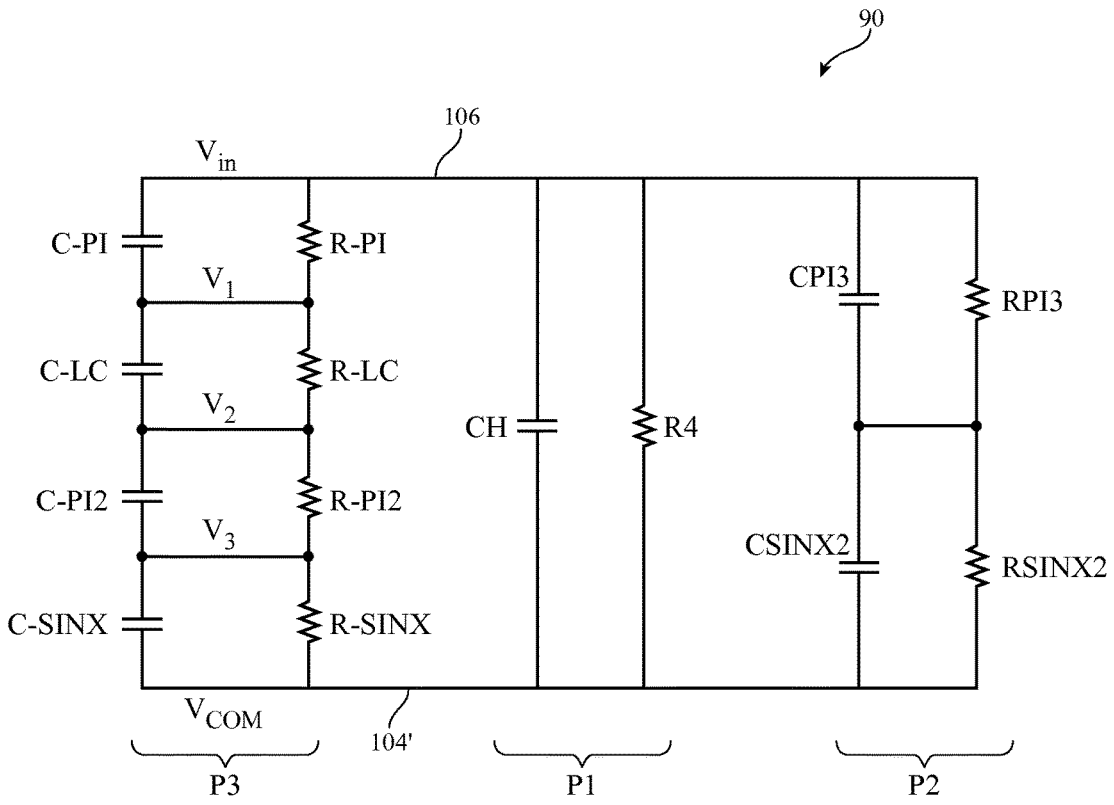
FIG. 9 is a circuit diagram of the illustrative pixel structures of FIG. 8 in accordance with an embodiment.

Electric fields are established between electrodes 106 (at voltage Vin) and layer 104' (at Vcom). These electric fields include fields that travel along paths such as illustrative paths P1, P2, and P3. Voltages may be established at the interfaces between the layers of pixel 90. For example, voltages V1, V2, and V3 may be established at the interfaces between layers 132, 52', and 130 along path P3, as shown in FIG. 8. Each dielectric layer in pixel 90 is associated with a capacitance and resistance. Because paths P1, P2, and P3 of FIG. 8 run parallel to one another, the network diagram for pixel 90 of FIG. 8 appears as shown in FIG. 9. Along each path, a series of capacitances and parallel resistances are coupled in series between electrode 106 and common voltage electrode 104'. Charges that accumulate in the pixel capacitances can discharge through the circuit of FIG. 9, so by modeling the behavior of the circuit of FIG. 9 as a function of time during the operation of display 14, charge accumulation in display 14 can be predicted. If charge accumulation becomes excessive, appropriate remedial action can be taken.

In path P1 of FIG. 9, capacitance CH and resistance RH represent the capacitance and resistance respectively of layer 130 between electrode 106 and common voltage electrode 104' of FIG. 8. In path P2 of FIG. 9, capacitance CPI3 and resistance RPI3 correspond respectively to the capacitance and resistance of layer 132 along path P2 and capacitance CSINX2 and resistance RSINX2 correspond respectively to the capacitance and resistance of layer 130 along path P2. In path P3 of FIG. 9, there are four pairs of capacitances and parallel resistances and these four pairs of capacitances and resistances are each coupled in series between electrode 106 and common voltage electrode 104'. The four pairs of capacitances and resistances associated with path P3 include: capacitance C-PI and resistance R-PI corresponding to layer 132 along path P3 between electrode 106 and the interface between layer 132 and layer 52', capacitance C-LC and resistance R-LC corresponding to layer 52', capacitance C-PI2 and resistance RPI-2 corresponding to an additional traversal of the electric field through layer 132, and capacitance C-SINX and resistance R-SINX corresponding to layer 130. The values of each of the circuit components in the network of FIG. 9 may be calculated from the known sizes, shapes, and materials of the structures of FIG. 8 and/or empirically gathered data.

FIG. 10 shows a charge accumulation modeling equation that may be used to compute the current state of charge in pixels 90. The equation of FIG. 10 uses matrix algebra and interrelates current state matrix [CS] with input response matrix [IR], input voltage Vinlk, state response matrix [SR], and previous state matrix [PS]. Voltage Vinlk represents the input voltage (Vp of FIG. 6 and Vin of FIG. 8) on electrodes 106 for one or more pixels (e.g., the maximum voltage or average voltage on all of the pixels in a block-shaped region of display 14, the maximum voltage or average voltage on the pixels of display 14, etc.). Processing complexity may be minimized by evaluating the expression of FIG. 10 for all pixels 90 in display 14 (e.g., by using a maximum pixel voltage, average pixel voltage, or other representative pixel voltage as input voltage Vinlk), but charge accumulation calculation accuracy may be improved by breaking display 14 into smaller pixel blocks for charge accumulation estimation purposes.

Input response matrix [IR] represents the response of a pixel to a given input voltage. Input response matrix [IR] of FIG. 10 is a 3×1 matrix having three elements IR1, IR2, and IR3. Element IR1 represents the amount of voltage produced on node V1 of pixel 90 in response to application of a known voltage (e.g., 1 volt) at input Vin (electrodes 106). Similarly, element IR2 represents the amount of voltage produced at node V2 and element IR3 represents the amount of voltage produced at node V3. The values of the elements of input response matrix [IR] are frame duration dependent. The input response values (i.e., the values of the elements of matrix [IR]) increase with longer pixel signal (Vp) retention times (i.e., longer elapsed times between successive frames and corresponding updates to the current state [CS]). The values of input response matrix [IR] may be stored in a look-up table in device 10 for numerous different frame rates (i.e., numerous different pixel data retention times) and/or a number of representative frame rates.

State response matrix [SR] has elements that quantify the response of the pixel (e.g., the circuit of FIG. 9) to the previous state [PS]. Previous state matrix [PS] of FIG. 10 is a 4×1 matrix whose first element Vinlk-1 represents the previous voltage input (previous Vin) to the pixel and whose second, third, and fourth elements represent the interface voltages V1, V2, and V2 of the pixel during the previous frame (i.e., the previous values of V1, V2, and V3 of FIG. 9). The rows of state response matrix [SR] serve as weighting factors that produce the expected interface voltages (V1, V2, and V2) based on the previous state matrix. For example, the product of the first row of matrix [SR] and [PS] produces the predicted value of V1 of FIG. 9. Likewise, the product of the second row of [SR] and [PS] produces the expected value of V2 and the product of the third row of [SR] and [PS] produces the expected value of V3. As with matrix [IR], the values of the elements of matrix [SR] increase with longer pixel signal (Vp) retention times (i.e., longer frame times). The values of state response matrix [SR] may be stored in the look-up table in device 10 for numerous different frame rates (i.e., numerous different pixel data retention times) and/or a number of representative frame rates.

The values of [IR] and [SR] may be determined by applying circuit simulation models to the circuit network of FIG. 9. The circuit simulation model may obtain solutions to the circuit of FIG. 9 by solving partial differential equations using Kickoff's current law. For example, to solve for the second column of matrix [SR], the value of V1 may be set to 1 volt and all other nodes (Vin=V2=V3=Vcom) may be set to 0 volts. The simulation model may then be run over a period of time to observe how these voltages distribute over the nodes of the FIG. 9 circuit network. Other matrix entries may be obtained in the same way. Matrix entries may be obtained over multiple temperatures; backlight output levels, frame rates, and other factors affecting the behavior of the circuit network of FIG. 9 and may be stored in look-up table circuitry in device 10.

Figure 11:
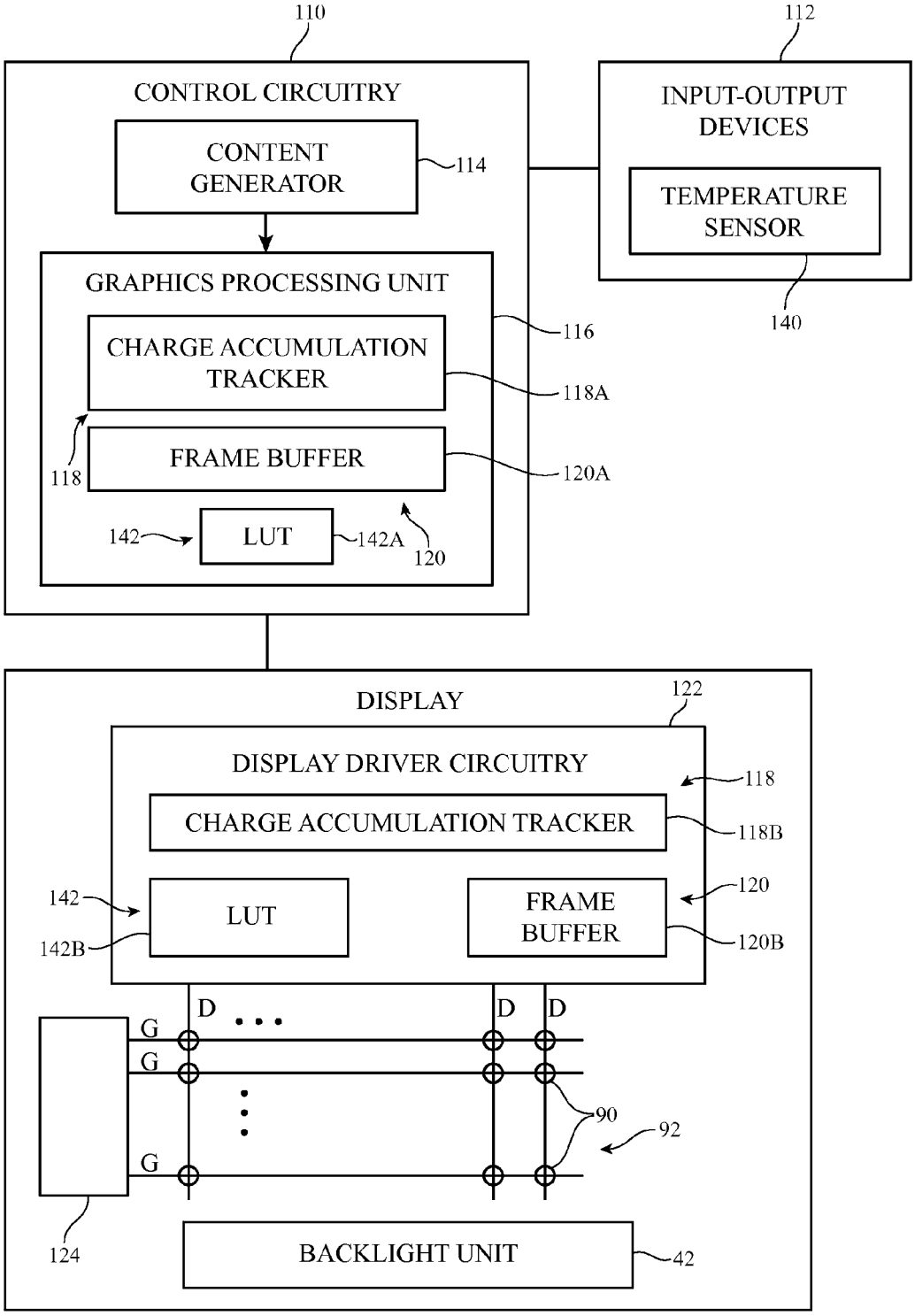
FIG. 11 is a diagram of illustrative circuitry that may be used in operating a display with charge accumulation monitoring capabilities in accordance with an embodiment.

Illustrative circuitry of the type that may be used by device 10 to control display 14 while monitoring charge accumulation is shown in FIG. 11. As shown in FIG. 11, device 10 may have control circuitry 110. Control circuitry 110 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 110 may be used to control the operation of device 10. The processing circuitry may be based on one or more microprocessors, microcontrollers, digital signal processors, baseband processors, power management units, audio chips, application specific integrated circuits, etc.

Control circuitry 110 may include a graphics processing unit such as graphics processing unit 116. Graphics processing unit 116 may receive image frames for frame buffer 120 (e.g., frame buffer 120A) from content generator 114. Content generator 114 may be an application running on control circuitry 110 such as a game, a media playback application, an application that presents text to a user, an operating system function, or other code running on control circuitry 110 that generates image data to be displayed on display 14. While displaying content on display 14, control circuitry 110 may adjust the output level of backlight unit 42, thereby controlling the amount of backlight 44 that passes through display 14 and the associated brightness level of images being displayed on display 14.

Control circuitry 110 may be coupled to input-output circuitry such as input-output devices 112. Input-output devices 112 may be used to allow data to be supplied to device 10 and to allow data to be provided from device 10 to external devices. Input-output devices 112 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 112 and may receive status information and other output from device 10 using the output resources of input-output devices 112. Input-output devices 112 may include a temperature sensor such as temperature sensor 140 to gather information on the current operating temperature of display 14.

Control circuitry 110 may be used to run software on device 10 such as operating system code and applications. During operation of device 10, the software running on control circuitry 110 (e.g., content generator 114) may display images on display 14 using pixels 90 of pixel array 92. Display 14 may include display driver circuitry such as display driver circuitry 122 (see, e.g., circuitry 62A and 62B of FIG. 5) that receives image data from graphics processing unit 116. The display driver circuitry of display 14 may include one or more display driver integrated circuits (e.g., a timing controller integrated circuit or other display driver circuitry such as display driver circuitry 122 of FIG. 9) and gate driver circuitry 124. Gate driver circuitry 124 may be implemented using thin-film transistor circuitry on a display substrate and/or may be implemented using one or more integrated circuits. Array 92 may have display driver circuitry such as circuitry 124 that is located on the left and right edges of array 92, on only the left edge or only the right edge of array 92, or that is located elsewhere in display 14.

Image frames to be displayed on array 92 by the display driver circuitry may be stored in frame buffer 120 (e.g., frame buffer 120B). Look-up table circuitry 142 such as look-up table 142A and/or look-up table 142B may be used to store information for modeling the charge accumulation behavior of display 14 (e.g., information for matrices [SR] and [IR] and other information for implementing a charge accumulation tracker based on a physically derived circuit model of pixels 90 such as charge accumulation tracker 118).

Charge accumulation tracker 118 may be implemented using resources in graphics processing unit 116 (see, e.g., charge accumulation tracker 118A) and/or using resources in display driver circuitry of display 14 (see, e.g., charge accumulation tracker 118B). Charge accumulation tracker 118 may use the circuit behavior of pixels 90 that is represented by the circuit of FIG. 9 to predict how much charge is being accumulated on the various nodes of pixels 90. The current charge accumulation state of the circuit of FIG. 9 may be represented by the charge accumulation current state matrix [CS] that is shown in FIG. 10. Information for the parameters of FIG. 10 may be stored in look-up table circuitry 142 or other storage in device 10.

Figure 12:
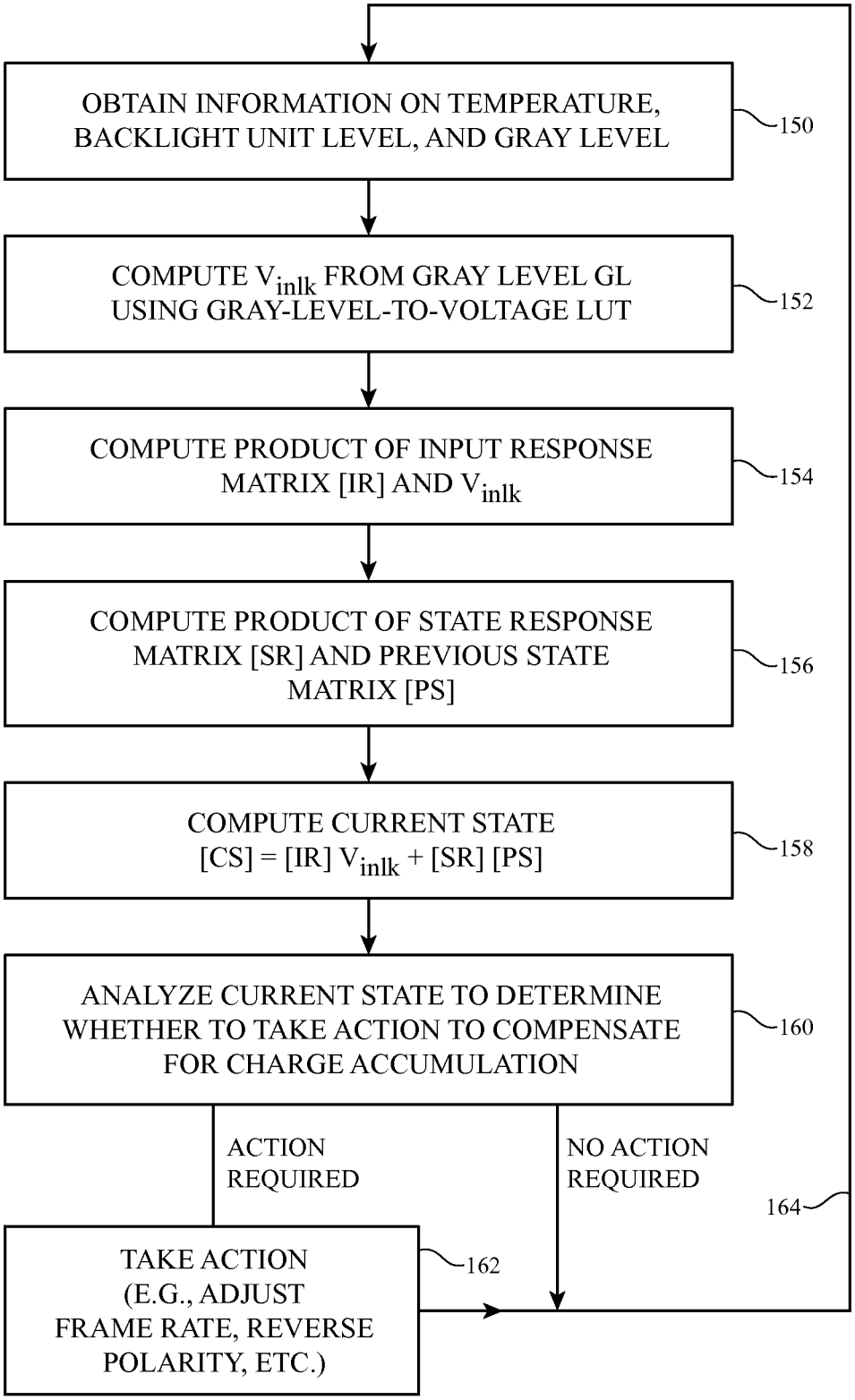
FIG. 12 is a flow chart of illustrative steps involved in operating a display with charge accumulation monitoring capabilities in accordance with an embodiment.

Illustrative steps involved in using charge accumulation tracker 118 to monitor charge accumulation conditions in display 14 are shown in FIG. 12.

At step 150, charge accumulation tracker 118 may obtain information on the current operating temperature of device 10 and display 14 from temperature sensor 140. The current gray level of the pixel or pixels being evaluated for charge accumulation may be obtained from frame buffer 120. Information on the current backlight level of backlight unit 42 may be obtained from control circuitry 110 and/or other circuitry in device 10 (e.g., graphics processing unit 116, display driver circuitry 122, etc.).

At step 152, gray-level-to-voltage mapping information that is stored in device 10 may be used to determine the voltage Vinlk (Vin of FIG. 10) for the pixels being evaluated based on the known digital gray level for the pixels (e.g., digital image data value between 0-255 or other range of digital gray level values). The maximum gray level for a set of pixels, the average gray level, or other representative gray level may be used when evaluating pixels in a region of display 14. As an example, if display 14 is divided into four blocks, the pixels of each of the four blocks may be associated with a respective a maximum gray level. The maximum gray level of each of the four blocks may therefore be used to determine the voltage Vinlk for that block (as an example). Other schemes for selecting a representative pixel voltage Vinlk for display 14 or a region of display 14 may be used, if desired. The use of a maximum gray level is merely illustrative.

At step 154, charge accumulation tracker 118 may compute the product of input response matrix [IR] and voltage Vinlk. The computations of step 154 and the other computations performed by charge accumulation tracker 118 may be performed once per frame, once per block in a frame composed of multiple regions (blocks), one per pixel, once per all negative polarity pixels (or subset of negative polarity pixels), once per all positive polarity pixels (or subset of positive polarity pixels), etc.

At step 156, the product of state response matrix [SR] and previous state matrix [PR] may be computed. (Initially, previous state matrix [PR] may be set to default initial values.)

At step 158, charge accumulation tracker 118 can compute the current charge accumulation state [CS] for the pixels of interest, using the equation of FIG. 10.

The values of [IR] and [SR] that are used at steps 154 and 156 to compute charge accumulation state [CS] of FIG. 10 may be retrieved from look-up table 142 based on the operating conditions gathered at step 150 and the current frame duration. In particular, charge accumulation tracker 118 may retrieve the values of [IR] and [SR] from look-up table 142 based on conditions such as operating temperature and backlight illumination level. Operating temperature may affect ion migration speed. Backlight unit brightness level affects polyimide resistance (i.e., the resistance of layer 132 of FIG. 8) and therefore affects the values of resistive circuit elements such as R-PI, R-PI2, and RPI3 of FIG. 9). The amount of time elapsed since the last update to current state [CS] (i.e., the duration for which the current image content has been displayed on display 14) is also preferably taken into account in determining which look-up table entries to retrieve for [IR] and [SR]. The amount of time that has elapsed since the last update to the current state may be associated with the current frame rate of display 14 or may be associated with a display hold time such as a relatively long display sleep time (e.g., 1 m, 10 m, etc). Look-up table 142 is preferably sufficiently large to store versions of [IR] and [SR] for multiple frame durations, multiple backlight unit levels, and multiple operating temperatures. Maintaining this information in look-up table 142 allows charge accumulation tracker 118 to evaluate the current status of charge accumulation in display 14 in real time based on the physically derived pixel circuit model that takes into account temperature, frame duration, and backlight level.

After computing the current charge accumulation state [CS] of the array of pixels in display 14 (e.g., a region of pixels covering part of display 14 or all of display 14), charge accumulation tracker 118 may analyze the current charge accumulation state (i.e., the values of matrix [CS]) to determine whether to take action to compensate for charge accumulation. Charge accumulation tracker 118 may, for example, compare the current charge accumulation state of display 14 to a predetermined threshold. If insufficient charge accumulation is present (in all or part of display 14), no action is required and processing may loop back to step 150, as indicated by line 164. If, however, there is excess charge accumulation present in display 14 (e.g., in all of display 14 or in any of the regions of display 14 that are being separately evaluated), compensating actions can be taken at step 162 (e.g., the frame rate of display 14 may be adjusted, additional frames of one or both polarities may be inserted into the frames being displayed on display 14, the polarity of the frame of data being displayed may be reversed, or other actions may be taken to reduce the accumulated charge.

To reduce the amount of memory consumed in implementing look-up table 142, charge accumulation tracker 118 may maintain only one set (or other small number of sets) of matrix entries for a known frame duration (e.g., 4 ms) or set of representative frame durations (e.g., 4 ms, 64 ms, etc.).

In situations in which the time that has elapsed since the last update to the current state exceeds that known duration, charge accumulation tracker 118 may loop through the current state [CS] update operation by an appropriately scaled number of times. As an example, if the amount of elapsed time since the last current state update is 40 ms and if the look-up table contains only entries corresponding to a 4 ms frame duration, tracker 118 can loop through the current state update operations of FIG. 10 ten times (because 40 ms/4 s equals 10).

If desired, a range of representative sets of look-up table entries for [IR] and [SR] may be stored (e.g., one for 4 ms of frame duration, one for 64 ms of frame duration, etc.). An appropriate number of computational loops may then be used for each of these sets of data to update [CS]. For example, if a frame duration of 72 ms is encountered, charge accumulation tracker 118 may apply the 4 ms data twice and the 64 ms data once (because 64 ms+2*4 ms is 72 ms).

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a display having an array of pixels;

control circuitry that generates image frames that are displayed on the array of pixels of the display;

a charge accumulation tracker that uses a physically derived circuit model of charge accumulation in the pixels to evaluate the image frames to identify when a risk of excessive charge accumulation in the display is present, wherein the charge accumulation tracker updates a current charge accumulation state based on a previous charge accumulation state, wherein there is an elapsed time from when the charge accumulation tracker most recently updated the current charge accumulation state, wherein the charge accumulation tracker updates the current charge accumulation state based on the elapsed time, wherein the charge accumulation tracker updates the current charge accumulation state by computing a product between a previous charge accumulation state and a charge accumulation state response matrix, wherein the charge accumulation tracker updates the current charge accumulation state by computing a product between a charge accumulation input response matrix and a current pixel input voltage, wherein the charge accumulation tracker updates the current charge accumulation state by computing a sum of a first amount equal to the product of the previous charge accumulation state and the charge accumulation state response matrix and a second amount equal to the product between the charge accumulation input response matrix and the current pixel input voltage;

look-up table circuitry that stores the charge accumulation state response matrix and the charge accumulation input response matrix;

a temperature sensor, wherein the charge accumulation tracker retrieves versions of the charge accumulation state response matrix and the charge accumulation input response matrix from the look-up table circuitry based on a temperature measurement from the temperature sensor; and a backlight that provides backlight illumination to the array of pixels at a backlight illumination level, wherein the charge accumulation tracker retrieves versions of the charge accumulation state response matrix and the charge accumulation input response matrix from the look-up table circuitry based on the backlight illumination level, wherein the charge accumulation tracker updates the current charge accumulation state by applying the charge accumulation state response matrix and charge accumulation input response matrix a number of times that is based on the elapsed time, and wherein the charge accumulation tracker compares the current charge accumulation state to a threshold to determine whether to take a remedial action.

2. The electronic device defined in claim 1 wherein the charge accumulation tracker uses temperature information from the temperature sensor to identify when the risk of excessive charge accumulation is present.

3. The electronic device defined in claim 1 wherein the charge accumulation tracker uses the backlight illumination level to identify when the risk of excessive charge accumulation is present.

4. An electronic device that displays images frames, comprising:

an array of liquid crystal display pixels that displays the image frames, wherein the array of liquid crystal display pixels includes pixel electrodes and a common electrode; and circuitry that implements a charge accumulation tracker, wherein the charge accumulation tracker analyzes the image frames to identify when there is a risk of excess charge accumulation in the array using a circuit model of charge accumulation in the pixels in the display, and wherein the circuit model of charge accumulation is based on paths of electric fields between the pixel electrodes and the common electrode.

5. The electronic device defined in claim 4 comprising a look-up table that stores a charge accumulation state response matrix and a charge accumulation input response matrix.

6. The electronic device defined in claim 5 wherein the charge accumulation tracker uses the charge accumulation state response matrix, the charge accumulation input response matrix, and a temperature measurement to identify when the risk of excessive charge accumulation is present.

7. The electronic device defined in claim 6 further comprising a backlight that supplies backlight illumination to the array of liquid crystal display pixels at a backlight illumination level and wherein the charge accumulation tracker uses the backlight illumination level in identifying when the risk of excessive charge accumulation is present.

8. An electronic device that displays images frames, comprising:

an array of liquid crystal display pixels that displays the image frames; and circuitry that implements a charge accumulation tracker to identify when there is a risk of excess charge accumulation in the array, wherein the charge accumulation tracker updates a current charge accumulation state for the array by computing a sum of a first amount equal to a product of a previous charge accumulation state and a charge accumulation state response matrix and a second amount equal to a product between a charge accumulation input response matrix and a current pixel input voltage.

9. The electronic device defined in claim 8 further comprising a temperature sensor that provides a temperature measurement and a backlight that provides backlight illumination to the array at a backlight illumination level, wherein the charge accumulation tracker receives the temperature measurement and the backlight illumination level as inputs.

* * * * *